US010100762B2

(12) United States Patent
Murata

(10) Patent No.: US 10,100,762 B2
(45) **Date of Patent: *Oct. 16, 2018**

(54) ENGINE CONTROL DEVICE

(71) Applicant: TOYOTA JIDOSHA KABUSHIKI KAISHA, Toyota-shi (JP)

(72) Inventor: Toshio Murata, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 239 days.

This patent is subject to a terminal disclaimer.

(21) Appl. No.: 15/069,624

(22) Filed: Mar. 14, 2016

(65) Prior Publication Data

US 2016/0298558 A1 Oct. 13, 2016

(30) Foreign Application Priority Data

Apr. 9, 2015 (JP) ..... 2015-080119

(51) Int. Cl.

| | |
|---|---|
| ***F02D 41/02*** | (2006.01) |
| ***F01N 3/00*** | (2006.01) |
| ***F02D 41/06*** | (2006.01) |
| ***F02D 9/02*** | (2006.01) |
| ***F02D 31/00*** | (2006.01) |

(Continued)

(52) U.S. Cl.

CPC ..... *F02D 41/0235* (2013.01); *F01N 3/005* (2013.01); *F02D 9/02* (2013.01); *F02D 31/003* (2013.01); *F02D 33/006* (2013.01); *F02D 33/02* (2013.01); *F02D 41/061* (2013.01); *F02D 41/062* (2013.01); *F02D 41/064* (2013.01);

(Continued)

(58) Field of Classification Search

CPC ..... F02D 41/0235; F02D 41/064; F02D 9/02; F02D 2009/0222; F01N 3/005

See application file for complete search history.

(56) References Cited

U.S. PATENT DOCUMENTS 6,073,440 A 6/2000 Douta
6,116,213 A 9/2000 Yasui et al.

(Continued)

FOREIGN PATENT DOCUMENTS

EP 0 874 151 A2 10/1998
JP 2006-161593 6/2006

(Continued)

OTHER PUBLICATIONS

Machine Translation of Kr 1020070088933, Translated on Jan. 16, 2018.*

(Continued)

*Primary Examiner* — Patrick Maines

(74) *Attorney, Agent, or Firm* — Oblon, McClelland, Maier & Neustadt, L.L.P.

(57) ABSTRACT

There is provided an engine control device including (1) a regulator that regulates a flow rate per unit of time of exhaust gas discharged from an engine, and (2) a controller that, in cases in which an external temperature detection section detects an external temperature below freezing point, and a previous engine operation duration is shorter than a predetermined first duration, controls the regulator such that the flow rate rises to exceed a predetermined normal state, until a predetermined second duration has elapsed since the engine was started up.

9 Claims, 5 Drawing Sheets

(51) Int. Cl.
*F02D 33/00* (2006.01)
*F02D 33/02* (2006.01)

(52) U.S. Cl.
CPC .... *F02D 41/067* (2013.01); *F02D 2009/0222* (2013.01)

(56) References Cited

U.S. PATENT DOCUMENTS

| | | | | |
|---|---|---|---|---|
| 6,295,808 | B1 | 10/2001 | Griffin | |
| 2002/0134340 | A1 | 9/2002 | Watanabe et al. | |
| 2006/0236678 | A1* | 10/2006 | Tanada | F01N 3/0814 60/277 |
| 2007/0017482 | A1* | 1/2007 | Nakashima | F02D 11/107 123/399 |
| 2007/0255485 | A1 | 11/2007 | Kaita | |
| 2008/0098986 | A1* | 5/2008 | McKay | F02D 11/107 123/396 |
| 2009/0032213 | A1 | 2/2009 | Mukoubara et al. | |
| 2010/0180578 | A1 | 7/2010 | Goda | |
| 2011/0004392 | A1* | 1/2011 | Senda | F02P 5/1516 701/102 |
| 2011/0178665 | A1 | 7/2011 | Yohioka et al. | |
| 2012/0221185 | A1 | 8/2012 | Yamazaki | |
| 2013/0024088 | A1* | 1/2013 | Suzuki | F02D 41/1494 701/102 |
| 2015/0047609 | A1 | 2/2015 | Kleczewski et al. | |
| 2015/0218998 | A1 | 8/2015 | Ishihata et al. | |

FOREIGN PATENT DOCUMENTS

| | | | |
|---|---|---|---|
| JP | 2009264267 | A * | 11/2009 |
| JP | 2012-61898 | | 3/2012 |
| JP | 2015-145663 | A | 8/2015 |
| KR | 1020070088933 | * | 2/2006 |

OTHER PUBLICATIONS

Extended European Search Report dated Nov. 2, 2016 in Patent Application No. 16161024.1

Office Action dated Jan. 22, 2018 in co-pending U.S. Appl. No. 15/213,955.

U.S. Office Action dated Aug. 9, 2018 for U.S. Appl. No. 15/213,955.

* cited by examiner

FIG.3

| | CONDITIONS |
|---|---|
| (1) | EXTERNAL TEMPERATURE IS 0°C OR BELOW |
| (2) | (1) + WITHIN 10 MINUTES SINCE ENGINE START-UP (DURATION MAY BE REPLACED BY GASOLINE CONSUMPTION AMOUNT, ENGINE WATER TEMPERATURE, OR THE LIKE) |
| (3) | (1) + PREVIOUS ENGINE ON DURATION IS LESS THAN 10 CONTINUOUS MINUTES |
| (4) | (1) + RAISE NUMBER OF REVOLUTIONS FOR SEVERAL SECONDS ONCE EVERY SEVERAL MINUTES (INTERMITTENTLY) |
| (5) | (1) + VEHICLE SPEED IS 10 KM/H OR ABOVE |
| (6) | (1) + AIR INTAKE AMOUNT AFTER STARTING CONTROL IS A PREDETERMINED VALUE |
| (7) | (1) + SHIFT IS IN R RANGE |
| (8) | COMBINATION OF (2) TO (7) |

ENGINE CONTROL DEVICE

CROSS-REFERENCE TO RELATED APPLICATION

This application claims priority under 35 USC 119 from Japanese Patent application, No. 2015-080119 filed on Apr. 9, 2015, the disclosure of which is incorporated by reference herein.

BACKGROUND

Technical Field

The present disclosure relates to an engine control device.

Related Art

Japanese Patent Application Laid-Open (JP-A) No. 2006-161593 includes an engine drive mode employing the power of an engine, an EV drive mode employing the power of a motor or a generator, and a hybrid drive mode employing the power of both the engine and the motor or generator. When conditions to stop the EV drive mode are met, the engine noise is increased by increasing the number of engine revolutions, and the driver is prompted to perform a switching operation between the engine drive mode and the hybrid drive mode.

However, in vehicles including an engine, when the previous travelling duration was short and the external temperature is below freezing point, and so on, there is a possibility that condensed water remaining inside an exhaust pipe freezes. Under such circumstances in which the inside of the exhaust pipe freezes, it is necessary to increase the number of engine revolutions in order to discharge the condensed water and melt the ice inside the exhaust pipe. However, there is room for improvement in JP-A No. 2006-161593, since the timing is different to the stopping conditions of the EV mode.

SUMMARY

In consideration of the above circumstances, the present disclosure promotes the draining of condensed water and the thawing of ice inside an exhaust pipe.

A first aspect of the present disclosure is an engine control device including a regulator that regulates a flow rate per unit of time of exhaust gas discharged from an engine; and a controller that, in cases in which an external temperature detection section detects an external temperature below freezing point, and a previous engine operation duration is shorter than a predetermined first duration, controls the regulator such that the flow rate rises to exceed a predetermined normal state, until a predetermined second duration has elapsed since the engine was started up.

In the first aspect, the flow rate per unit of time of exhaust gas discharged from the engine is regulated by the regulator.

In cases in which a temperature below freezing point is detected by the external temperature detection section for detecting external temperature, and the previous engine operation duration is shorter than the predetermined first duration, the controller controls the regulator such that the flow rate per unit of time of the exhaust gas rises to exceed the predetermined normal state, until the predetermined second duration has elapsed since the engine was started up. Namely, in cases below freezing point, and in which the previous engine operation duration is shorter than the first duration, there is a possibility of the inside of an exhaust pipe freezing, and so raising the flow rate per unit of time of the exhaust gas enables the draining of condensed water and the thawing of ice inside the exhaust pipe to be promoted. Note that an idling state after completion of a warm-up operation is complete may be applied as the normal state. Alternatively, an idling state, including a controlled engine state (such as the warm-up operation) in which the flow rate of the exhaust gas has risen by increasing the number of engine revolutions by making various corrections, such as an external temperature correction, a water temperature correction, or an atmospheric pressure correction, may be applied. Moreover, the first duration and the second duration may be replaced by measuring the number of continuous revolutions or the like after engine start-up, corresponding to the first duration and the second duration.

A second aspect of the present disclosure is the engine control device of the first aspect, wherein the regulator regulates the flow rate by regulating the number of engine revolutions. A third aspect of the present disclosure is the engine control device of the second aspect, wherein the regulator regulates the number of engine revolutions by regulating a throttle position that regulates an air intake amount to the engine.

A fourth aspect of the present disclosure is the engine control device of any one of the first aspect to the third aspect, wherein the controller starts to control the regulator in cases in which a vehicle speed is a predetermined vehicle speed indicating that travelling has started, or above. The fourth aspect enables drainage in a vehicle parking space to be suppressed, and dirtying of the vehicle parking space to be prevented.

A fifth aspect of the present disclosure is the engine control device of any one of the first aspect to the fourth aspect, wherein in cases in which the flow rate has risen and an air intake amount per unit of time has exceeded a predetermined amount of air, the controller further controls the regulator such that the raising of the flow rate is stopped and the flow rate becomes the normal state. In the fifth aspect, since the number of revolutions rises when the large air intake amount has increased, further control to raise the exhaust gas flow rate is not required, and so a deterioration in fuel efficiency can be prevented by stopping control by the regulator.

A sixth aspect of the present disclosure is the engine control device of any one of the first aspect to the third aspect, wherein in cases in which a position detection section detects that a shift position is a reverse position, the controller starts control of the regulator. In the sixth aspect, the influence toward the rear can be reduced by increasing the flow rate and draining condensed water when reversing.

A seventh aspect of the present disclosure is the engine control device of any one of the first aspect to the sixth aspect, wherein when controlling the regulator, the controller controls the regulator such that the flow rate rises for a predetermined duration at predetermined intervals in time. In the seventh aspect, discharge of water and thawing of ice may be performed by intermittent control after a certain degree of condensed water has accumulated, rather than constantly draining condensed water and thawing ice.

An eighth aspect of the present disclosure is the engine control device of any one of the first aspect to the seventh aspect, wherein the controller is provided to a hybrid vehicle. Namely, in hybrid vehicles, the engine is sometimes stopped, and the engine operation duration is short, such that condensed water is liable to occur and the exhaust pipe liable to freeze; however, the eighth aspect enables this to be reliably prevented.

A ninth aspect of the present disclosure is the engine control device of any one of the first aspect to the eighth aspect, further including an exhaust heat recovery unit that is provided at a downstream side of a catalyst for purifying exhaust gas and that recovers heat from exhaust gas. The ninth aspect enables both exhaust heat to be recovered by the exhaust heat recovery unit, and freezing inside the exhaust pipe to be suppressed.

The present disclosure as explained above enables the draining of condensed water and the thawing of ice inside the exhaust pipe to be promoted.

BRIEF DESCRIPTION OF THE DRAWINGS

Exemplary embodiments of the present disclosure will be described in detail based in the following figures, wherein:

FIG. 3 is table illustrating an example of conditions for performing control to raise the number of engine revolutions;

DETAILED DESCRIPTION

Figure 1:
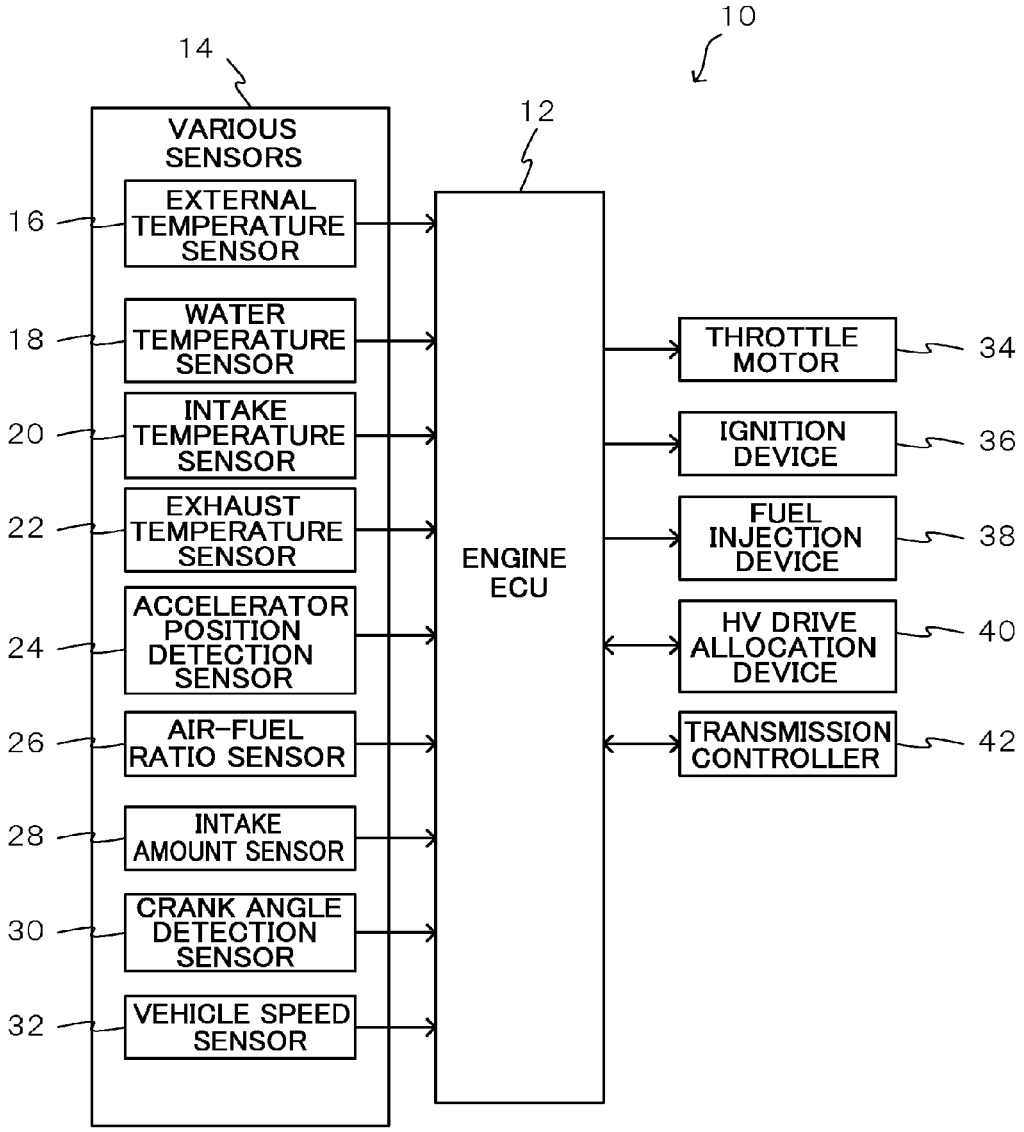
FIG. 1 is a block diagram illustrating a schematic configuration of an engine control device according to an exemplary embodiment.

Detailed explanation follows regarding an example of an exemplary embodiment, with reference to the drawings. FIG. 1 is a block diagram illustrating a schematic configuration of an engine control device according to the present exemplary embodiment. Note that an engine control device installed in a hybrid vehicle including an engine and a motor as drive sources for travelling is explained below as an example of the engine control device.

An engine control device 10 according to the present exemplary embodiment includes an engine Electronic Control Unit (ECU) 12 serving as a controller that controls operation of the engine. The engine ECU 12 is configured by a microcomputer including a Central Processing Unit (CPU), Read Only Memory (ROM), Random Access Memory (RAM), and the like.

Various sensors 14 for controlling operation of the engine are connected to the engine ECU 12, and operation of the engine is controlled based on detection results of the various sensors 14. An external temperature sensor 16 serving as an external temperature detection section, a water temperature sensor 18, an intake temperature sensor 20, an exhaust temperature sensor 22, an accelerator position detection sensor 24, an air-fuel ratio sensor 26, an intake amount sensor 28, a crank angle detection sensor 30, and a vehicle speed sensor 32 are connected to the engine ECU 12 as the various sensors 14. Note that the various sensors 14 described above are merely examples and are not limited thereto, and some of the sensors may be omitted, or other sensors may be included.

The external temperature sensor 16 detects the external temperature, the water temperature sensor 18 detects the temperature of cooling water in the engine, the intake temperature sensor 20 detects the intake temperature of the engine, and the exhaust temperature sensor 22 detects the temperature of exhaust gas from the engine. The accelerator position detection sensor 24 detects the position of the accelerator, the air-fuel ratio sensor 26 detects the air-fuel ratio of exhaust gas from the engine, the intake amount sensor 28 detects the air intake amount to the engine, the crank angle detection sensor 30 detects the crank angle, and the vehicle speed sensor 32 detects the vehicle speed.

A throttle motor 34 serving as a regulator, an ignition device 36, a fuel injection device 38, a Hybrid Vehicle (HV) drive allocation device 40, and a transmission controller 42 are connected to the engine ECU 12 in order to control operation of the engine. The throttle motor 34 regulates the throttle position by driving the throttle that regulates the air intake amount to the engine. The ignition device 36 generates sparks required in order to start combustion of an air-fuel mixture that has been compressed inside cylinders of the engine. The fuel injection device 38 supplies air-fuel mixture into the cylinders of the engine by injecting fuel. The HV drive allocation device 40 controls the drive allocation between the engine and the motor that are power sources used for travelling, and outputs an engine start-up request to the engine ECU 12 when the engine needs to be started up. The transmission controller 42 controls the gear ratio in transmissions in which the gear ratio can be changed (such as continuously variable transmissions). Note that the transmission controller 42 functions as a position detection section, and has a function to detect the shift position, such as a reverse position.

The engine ECU 12 controls operation of the engine by controlling the throttle motor 34, the ignition device 36, the fuel injection device 38, and so on, based on the detection results of the various sensors 14. The engine ECU 12 also allocates drive to the engine or the motor according to the circumstances, and controls the transmission.

Figure 2:
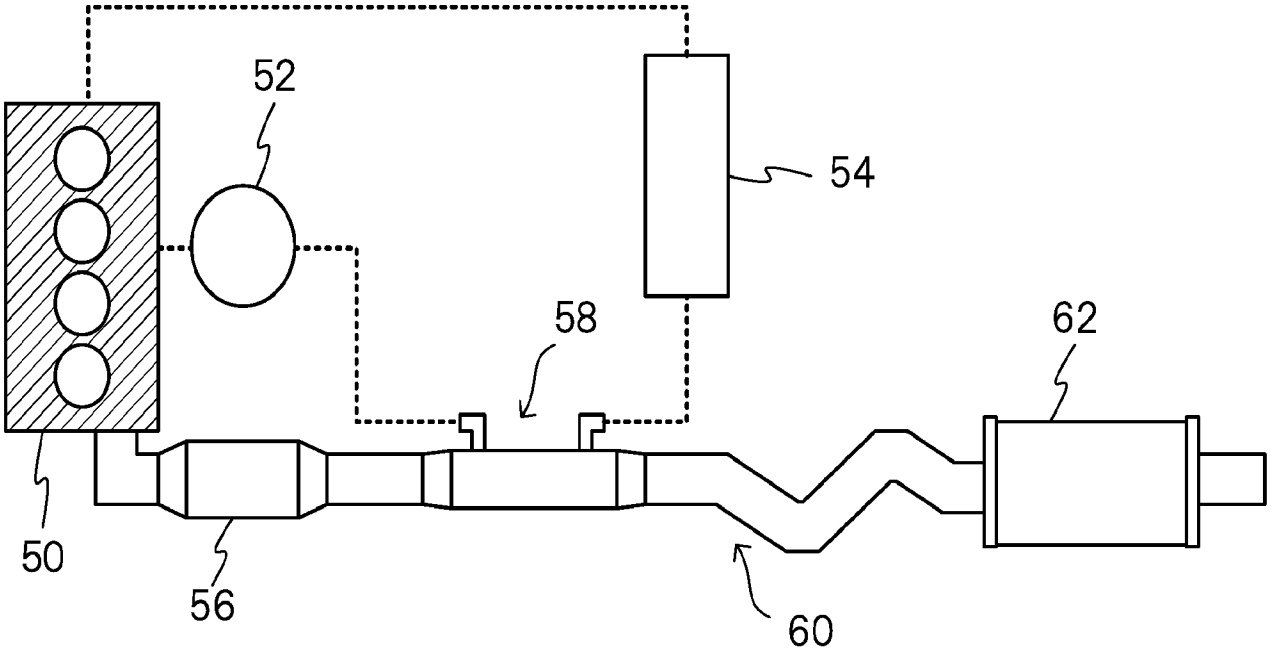
FIG. 2 is a diagram for explaining an exhaust heat recovery unit.

The vehicle installed with the engine control device 10 according to the present exemplary embodiment is also provided with an exhaust heat recovery unit. FIG. 2 is a diagram for explaining the exhaust heat recovery unit.

An exhaust heat recovery unit 58 is provided to an exhaust pipe 60 through which exhaust gas of the automobile passes, and the exhaust heat recovery unit 58 recovers heat in the exhaust gas from the automobile engine, and utilizes this heat for heating assisting engine warm-up, and so on.

As illustrated in FIG. 2, for example, a catalyst device 56, the exhaust heat recovery unit 58, and a main muffler 62 are installed in sequence from upstream on a discharge path of the exhaust pipe 60 along which exhaust gas from an engine 50 is discharged.

The exhaust heat recovery unit 58 is provided at the downstream side of the catalyst device 56, and recovers heat from the exhaust gas. Specifically, in the exhaust heat recovery unit 58, cooling water for cooling the engine 50 is circulated by a water pump (W/P) 52. Cooling water circulated in the exhaust heat recovery unit 58 is configured to flow to a heater core 54 and return to the engine 50. Namely, the exhaust heat recovery unit 58 is provided on a flow path of the cooling water, and heat from the exhaust gas is recovered by the exhaust heat recovery unit 58 to increase the temperature of the cooling water, which can be utilized as a heat source for a heater. Note that an electrical type water pump driven by the motor, for example, may be applied as the water pump 52, and the water pump 52 may vary the flow rate of cooling water flowing through the exhaust heat recovery unit 58. The recovery rate of exhaust heat can be regulated by regulating the flow rate of cooling water flowing through the exhaust heat recovery unit 58.

However, in a vehicle that travels using the engine 50, when the water condenses inside the exhaust pipe 60 without being discharged and the external temperature falls below freezing point, there is a possibility that the condensed water freezes. When condensed water freezes inside the exhaust pipe 60 then, depending on the travelling conditions, it is possible that the condensed water remains without melting. When the condensed water that is still frozen remains, then more water condenses and freezes, and there is a possibility that this leads to a reduction in engine output, a deterioration in vehicle interior noise that is exhaust noise, and so on, due to a drop in exhaust performance. In particular, in vehicles that are hybrid vehicles and include the exhaust heat recovery unit 58 as in the present exemplary embodiment, the engine is sometimes stopped while the vehicle is travelling, such that condensed water is more liable to occur. Moreover, as illustrated in FIG. 2, the exhaust pipe 60 is configured with differences in height in order to avoid other components, such that is it is difficult to drain the condensed water rearward without the flow speed of the exhaust gas (the number of engine revolutions) being at a certain level.

In the present exemplary embodiment, the engine ECU 12 controls such that the flow rate per unit of time of exhaust gas rises above a predetermined normal state, in order to drain the condensed water and to thaw frozen ice inside the exhaust pipe 60. During control to raise the flow rate of the exhaust gas, specifically, in cases in which the freezing inside the exhaust pipe 60 has met predetermined anticipated conditions, the engine ECU 12 controls the throttle motor 34 such that the number of engine revolutions is greater than a predetermined normal state. However, since the capability to drain condensed water, the capability to melt ice, and so on differ according to engine specification (such as an exhaust rate and compression ratio, and an exhaust port diameter), the diameter of the exhaust pipe 60, and so on, the degree by which to raise the flow rate of the exhaust gas is predetermined according to the engine specification, the exhaust pipe 60 diameter, and so on. For example, the flow rate per unit of time in order to raise the exhaust gas flow rate to a rate capable of draining condensed water and melting ice is predetermined according to at least one out of the engine specification, or the exhaust pipe diameter. Note that an idling state after a warm-up operation has been completed may be applied as the predetermined normal state. Alternatively, an idling state, including a controlled engine state (such as the warm-up operation) in which the flow rate of the exhaust gas has been raised by raising the number of engine revolutions by making various corrections, such as an external temperature correction, a water temperature correction, or an atmospheric pressure correction, may be applied. Other than the idling state, an operation state of a predetermined number of engine revolutions with respect to the accelerator position may be applied as the normal state. Control by the engine ECU 12 such that the flow rate of the exhaust gas is raised above the normal state is different to control of the warm-up operation when cold.

In the present exemplary embodiment as an example, conditions (1) to (8) illustrated in FIG. 3 are applied as the predetermined conditions for performing control to raise the number of engine revolutions.

In (1), in a case in which the external temperature is below freezing point (0° C. or less), namely, a temperature at which condensed water inside the exhaust pipe 60 freezes, the flow rate of the exhaust gas is raised, and condensed water and ice are discharged.

In (2) in a case in which, in addition to condition (1), it is within a predetermined duration (such as 10 minutes) of engine operation duration since engine start-up, namely, in a state prior to melting of ice that was formed after previously travelling, the flow rate is raised and discharge is performed in order to prevent further accumulation. Note that the gasoline consumption amount corresponding to the duration after engine start-up, the temperature of the cooling water, the number of continuous revolutions after engine start-up, or the like may be measured instead of the duration. Moreover, since the amount of heat generated in the predetermined duration after start-up differs according to the engine specification (such as the exhaust rate and the compression ratio, and the exhaust port diameter), the diameter of the exhaust pipe 60, and the like, a predetermined duration is applied according to the engine specification and the diameter of the exhaust pipe 60.

In (3), in a case in which in addition to condition (1), the previous engine start-up duration was less than a predetermined continuous duration (such as 10 minutes) and the ice from the time before last was not melted during the previous travelling (a double deposited state), the flow rate of the exhaust gas is raised, and the ice is melted and discharged. Note that, since the amount of heat generated in the predetermined duration differs according to the engine specification, the diameter of the exhaust pipe 60, and so on, a predetermined duration is applied according to the engine specification and the diameter of the exhaust pipe 60.

In (4), in addition to condition (1), by performing control to raise the number of revolutions for a duration of several seconds once every several minutes (by intermittently raising the number of engine revolutions for a predetermined duration at predetermined intervals in time), condensed water is discharged when it has accumulated to a certain extent, rather than condensed water being continuously discharged.

In (5) in a case in which, in addition to condition (1), the vehicle speed is a predetermined vehicle speed (such as 10 km/h), or above, the condensed water is discharged while the vehicle is travelling, since a parking space such as a garage would become dirty if the condensed water was discharged while the vehicle was stationary. Note that the predetermined vehicle speed is a vehicle speed that indicates that travelling has started, and is not limited to 10 km/h.

In (6) in a case in which, in addition to condition (1), a maximum Ga (such as the maximum air intake amount or the maximum number of engine revolutions) after starting control to raise the number of revolutions has exceeded a predetermined value (such as 10 g/s), control is stopped for several minutes (such as 3 minutes), and then restarted. Namely, in cases in which the air intake amount while the vehicle is travelling has exceeded a predetermined amount of air and the exhaust gas flow rate has risen, control to raise the number of revolutions is not required and so is stopped, thereby preventing a deterioration in fuel consumption.

In (7), when, in addition to condition (1), the gear shift is in the reverse (R) range, the exhaust gas flow rate is raised and condensed water and ice are discharged, since this indicates that there are no obstacles or people behind the vehicle, and that the drained water will not splash on anyone.

(8) is a combination of (2) to (7), in which the above conditions may be combined as appropriate. For example, implementation may be made of only (1), (2), and (3).

Figure 4:
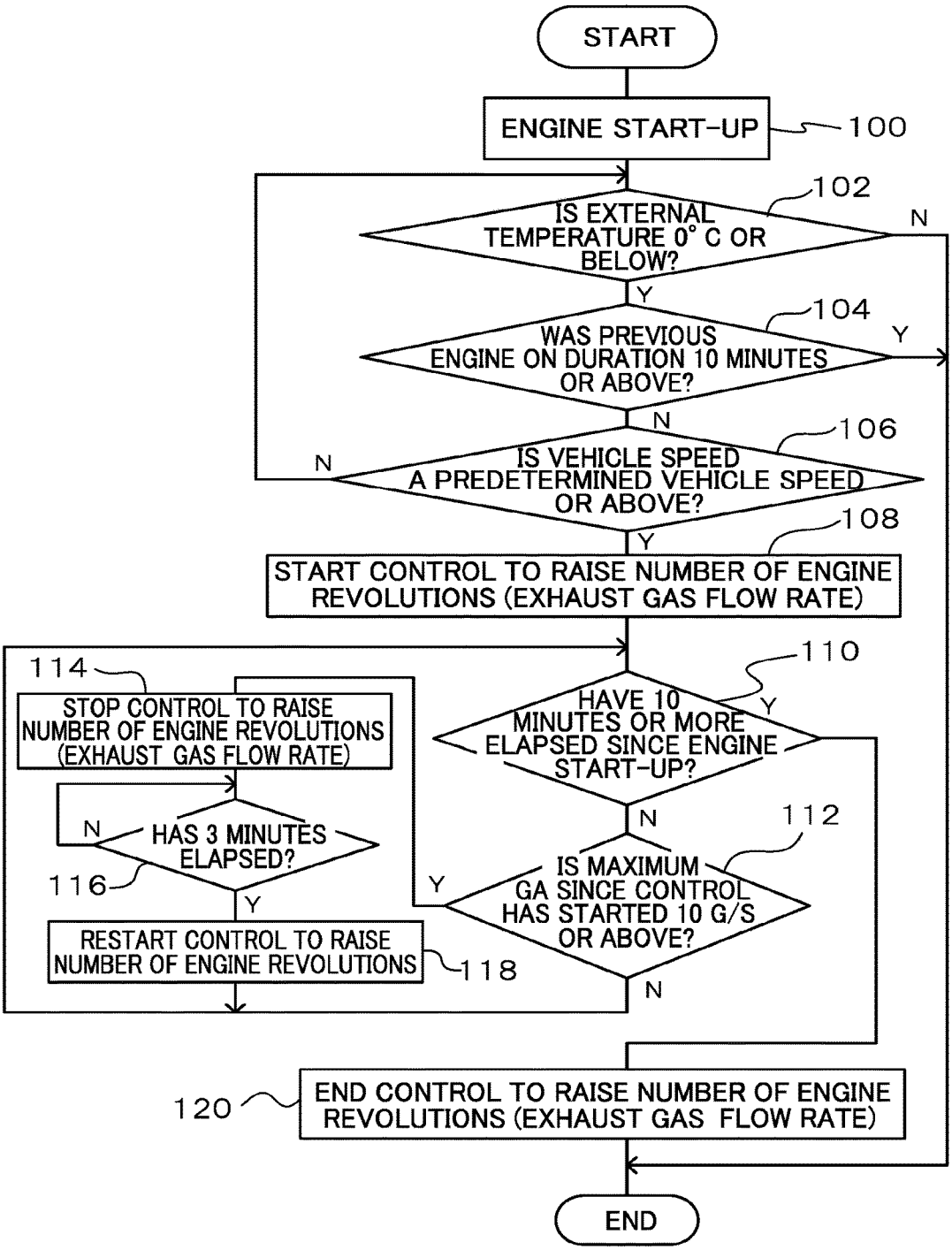
FIG. 4 is a flowchart illustrating an example of a flow of processing performed by an engine ECU of an engine control device according to the present exemplary embodiment.

Explanation follows regarding specific processing performed by the engine ECU 12 of the engine control device 10 according to the present exemplary embodiment configured as described above. FIG. 4 is a flowchart illustrating an example of a flow of processing performed by the engine ECU 12 of the engine control device 10 according to the present exemplary embodiment. Note that the processing in FIG. 4 starts if the engine ECU 12 has received an engine start-up request output from the HV drive allocation device 40.

At step 100, the engine ECU 12 starts up the engine, and proceeds to step 102.

At step 102, the engine ECU 12 determines whether or not the external temperature is 0° C. or below from the detection results of the external temperature sensor 16. In cases in which determination is affirmative, processing proceeds to step 104, and in cases in which determination is negative, the processing routine is ended. Note that the engine is stopped in cases in which an ignition, not illustrated in the drawings, is OFF, or an engine stop request has been received.

At step 104, the engine ECU 12 determines whether or not the previous engine start-up duration (engine ON duration) is a predetermined duration (such as 10 minutes), or above. This determination is determined by storing the previous engine start-up duration in the engine ECU 12. In cases in which determination is negative, processing proceeds to step 106, and in cases in which determination is affirmative, the processing routine is ended. Note that the engine is stopped in cases in which the ignition, not illustrated in the drawings, is OFF, or an engine stop request has been received.

At step 106, the engine ECU 12 determines whether or not the vehicle speed is a predetermined vehicle speed (such as 10 km/h), or above, from the detection results of the vehicle speed sensor 32. In cases in which determination is affirmative, processing proceeds to step 108, and in cases in which determination is negative, processing returns to step 102, and the above-described processing is repeated.

At step 108, the engine ECU 12 starts control to raise the number of engine revolutions (the exhaust gas flow rate), and proceeds to step 110. For example, the engine ECU 12 raises the exhaust gas flow rate by driving the throttle motor 34 to raise the number of engine revolutions. Condensed water and ice inside the exhaust pipe 60 is thereby discharged. Note that, since the vehicle would accelerate due to the number of engine revolutions being raised, acceleration due to raising the number of engine revolutions may be prevented by, for example, controlling the driving allocation between the engine and the motor using the HV drive allocation device 40. Alternatively, acceleration due to raising the number of engine revolutions may be prevented by controlling the transmission controller 42 to change the gear ratio. Note that control to raise the number of engine revolutions may be performed only intermittently for several seconds once every several minutes, rather than being performed continuously, for example.

At step 110, the engine ECU 12 determines whether or not a predetermined duration (such as 10 minutes) or above has elapsed since the engine has started up. In cases in which determination is negative, processing proceeds to step 112, and in cases in which determination is affirmative, processing proceeds to step 120.

At step 112, the engine ECU 12 determines whether or not a maximum Ga (such as the maximum air intake amount or the maximum number of engine revolutions) since the control to raise the number of engine revolutions started has exceeded a predetermined value (such as 10 g/s). In cases in which determination is affirmative, processing proceeds to step 114, and in cases in which determination is negative, processing returns to step 110, and the above-described processing is repeated.

At step 114, the engine ECU 12 stops the control to raise the number of engine revolutions (exhaust gas flow rate), and proceeds to step 116.

At step 116, the engine ECU 12 determines whether or not a predetermined duration (such as 3 minutes) has elapsed since the control to raise the number of engine revolutions stopped, stands by until the determination is affirmative, and then proceeds to step 118.

At step 118, the engine ECU 12 restarts the control to raise the number of engine revolutions, returns to step 110, and repeats the above-described processing. Namely, in cases in which the exhaust gas flow rate rises while the vehicle is travelling, control to raise the number of engine revolutions is not required and so is temporarily stopped, and then restarted after a predetermined duration has elapsed.

On the other hand, in cases in which the engine ECU 12 is performing control to raise the number of engine revolutions at step 120, this is ended, and the processing routine is ended. Note that, when the control to raise the number of engine revolutions is being stopped, a gradual return to a predetermined normal state may be employed such that the occupants do not feel any discomfort.

The engine ECU 12 performs control to raise the number of engine revolutions in this manner, thereby enabling the draining of condensed water and the thawing of ice inside the exhaust pipe 60 to be promoted.

Figure 5:
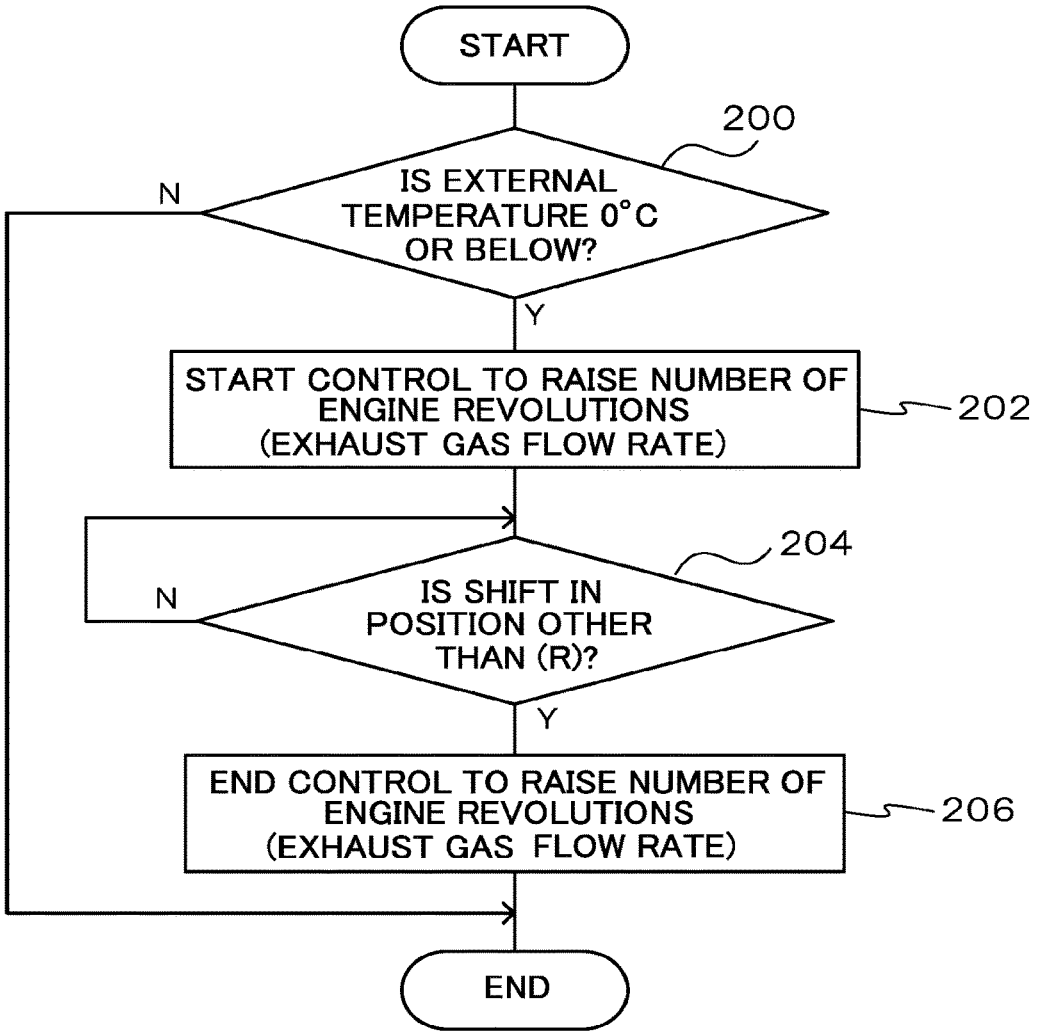
FIG. 5 is a flowchart illustrating an example of a flow of processing performed by an engine ECU when a shift position has been put in a reverse position in an engine control device according to the present exemplary embodiment.

Explanation follows regarding processing performed by the engine ECU 12 in a case in which the shift position has been put in the reverse (R) position. FIG. 5 is a flowchart illustrating an example of a flow of processing performed by the engine ECU 12 when the shift position has been put in the reverse position, in the engine control device 10 according to the present exemplary embodiment. Note that the processing in FIG. 5 is started if the shift position has been put in the reverse (R) position.

At step 200, the engine ECU 12 determines whether or not the external temperature is 0° C. or below from the detection results of the external temperature sensor 16. In cases in which determination is affirmative, processing proceeds to step 202, and in cases in which determination is negative, the processing is ended.

At step 202, the engine ECU 12 starts the control to raise the number of engine revolutions (the exhaust gas flow rate), and proceeds to step 204. For example, the engine ECU 12 raises the exhaust gas flow rate by driving the throttle motor 34 to raise the number of engine revolutions. Condensed water and ice inside the exhaust pipe 60 are thereby discharged. Note that, since the vehicle would accelerate due to the number of engine revolutions being raised, acceleration due to raising the number of engine revolutions may be prevented by, for example, controlling the driving allocation between the engine and the motor using the HV drive allocation device 40. Alternatively, acceleration due to raising the number of engine revolutions may be prevented by controlling the transmission controller 42 to change the gear ratio. Note that control to raise the number of engine revolutions may, for example, be performed only intermittently for several seconds once every several minutes, rather than being performed continuously.

At step 204, the engine ECU 12 determines whether or not the shift position has been put in a position other than the (R) position. This determination is determined by receiving a signal indicating the shift position from the transmission controller 42, for example. The engine ECU 12 stands by until determination is affirmative, and then proceeds to step 206.

At step 206, the engine ECU 12 ends the control to raise the number of engine revolutions, and the processing routine is ended.

Thus in cases in which the shift position has been put in the (R) position and the temperature is below freezing point, performing control to raise the number of engine revolutions enables the draining of condensed water and the thawing of ice inside the exhaust pipe 60 to be promoted, while reducing the effect of draining condensed water toward the rear.

Note that in the above exemplary embodiment, an example has been explained in which control is performed to raise the exhaust gas flow rate by raising the number of engine revolutions; however, the control to raise the exhaust gas flow rate is not limited thereto. For example, the exhaust gas flow rate may be raised without raising the number of engine revolutions by driving the throttle motor 34 to widen the throttle position and increase the air intake amount, and controlling the ignition device 36 such that the ignition timing is delayed.

A hybrid vehicle has been explained as an example in the above exemplary embodiment; however, there is no limitation to a hybrid vehicle. For example, application may be made to a vehicle that only travels using an engine.

In the above exemplary embodiment, a vehicle including the exhaust heat recovery unit 58 has been explained as an example; however, obviously application may also be made to vehicles that do not include the exhaust heat recovery unit 58.

The processing performed by the engine ECU 12 in the above exemplary embodiment may be stored and distributed as a program in a storage medium or the like.

The present disclosure is not limited by the above description, and obviously various other modifications may be implemented within a range not departing from the spirit thereof.

What is claimed is:

1. An engine control device comprising:

a regulator that regulates a flow rate per unit of time of exhaust gas discharged from an engine; and a controller configured such that when an external temperature sensor detects an external temperature below freezing point, and a previous engine operation duration is shorter than a predetermined first duration, controls the regulator such that the flow rate rises to exceed a predetermined normal state, until a predetermined second duration has elapsed since the engine was started up.

2. The engine control device of claim 1, wherein the regulator regulates the flow rate by regulating the number of engine revolutions.

3. The engine control device of claim 2, wherein the regulator regulates the number of engine revolutions by regulating a throttle position that regulates an air intake amount to the engine.

4. The engine control device of claim 1, wherein the controller starts to control the regulator when a vehicle speed is a predetermined vehicle speed indicating that travelling has started, or above.

5. The engine control device of claim 1, wherein when the flow rate has risen and an air intake amount per unit of time has exceeded a predetermined amount of air, the controller further controls the regulator such that the raising of the flow rate is stopped and the flow rate becomes the normal state.

6. The engine control device of claim 1, wherein when the controller detects that a shift position is a reverse position, the controller starts control of the regulator.

7. The engine control device of claim 1, wherein when controlling the regulator, the controller controls the regulator such that the flow rate rises for a predetermined duration at predetermined intervals in time.

8. The engine control device of claim 1, wherein the controller is provided to a hybrid vehicle.

9. The engine control device of claim 1, further comprising an exhaust heat recovery unit that is provided at a downstream side of a catalyst for purifying the exhaust gas and that recovers heat from exhaust gas.

* * * * *